United States Patent [19]

Veilleux

[11] 4,218,008

[45] Aug. 19, 1980

[54] CONTAINER HOLDING SOCKET FOR MOLDED TRAY

[75] Inventor: Gerald R. Veilleux, Waterville, Me.

[73] Assignee: Keyes Fibre Company, Waterville, Me.

[21] Appl. No.: 44,503

[22] Filed: Jun. 1, 1979

[51] Int. Cl.[3] ..... B65D 1/34; B65D 3/24

[52] U.S. Cl. ..... 229/2.5 R; 229/29 M; 229/15

[58] Field of Search ..... 229/1.5 H, 2.5 R, 29 S, 229/29 M; 206/201, 510; D9/176, 187; D7/38, 71

[56] References Cited

U.S. PATENT DOCUMENTS

| | | | |
|---|---|---|---|
| D. 250,243 | 11/1978 | Vigue | D7/38 |
| 2,766,919 | 10/1956 | Randall | 229/2.5 |
| 2,826,346 | 3/1958 | Randall | 229/2.5 X |
| 3,295,737 | 1/1967 | Page et al. | 229/2.5 |
| 3,362,606 | 1/1968 | Trimble | 229/29 M X |
| 3,542,280 | 11/1970 | Crabtree | 229/15 |
| 3,865,299 | 2/1975 | Crabtree | 229/29 M X |
| 3,915,371 | 10/1975 | Crabtree | 229/2.5 X |
| 3,942,671 | 3/1976 | Florian | 229/2.5 R X |
| 4,101,049 | 7/1978 | Wallace et al. | 229/2.5 R |

*Primary Examiner*—Davis T. Moorhead
*Attorney, Agent, or Firm*—Connolly and Hutz

[57] ABSTRACT

A unitary tray molded to substantially finished form of conventional fibrous pulp or foamed plastic material for use, for example, as an inexpensive disposable carry tray in fast food and beverage establishments, the tray featuring one or more sockets for holding a slightly tapered or straight walled beverage cup or other such container. The improved container holding socket has been developed to accommodate and stabilize not one but a range of sizes of containers, for example from the narrower size juice "glasses" to the several intermediate sizes of soft drink and coffee cups to the wider size milkshake containers. The container holding socket comprises preferably three stabilizing shoulders positioned in spaced apart opposition to each other at a height significantly above the bottom of the socket, to hold the wider sizes of containers and support them against tipping. The socket further includes inwardly contoured stabilizing walls extending downwardly beneath each of the shoulders to position and hold the narrower sizes of container, the stabilizing walls being yieldable outwardly to accommodate and support the intermediate sizes of containers.

10 Claims, 7 Drawing Figures

Fig. 1.
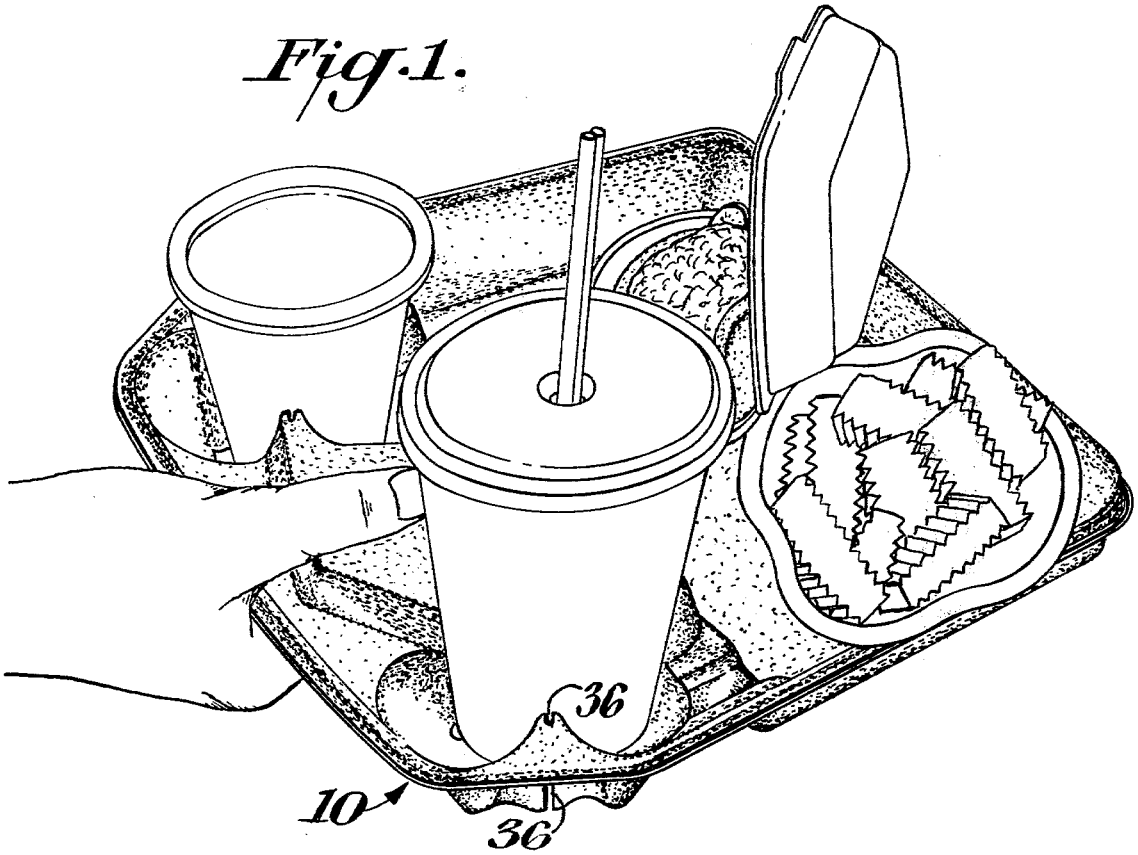
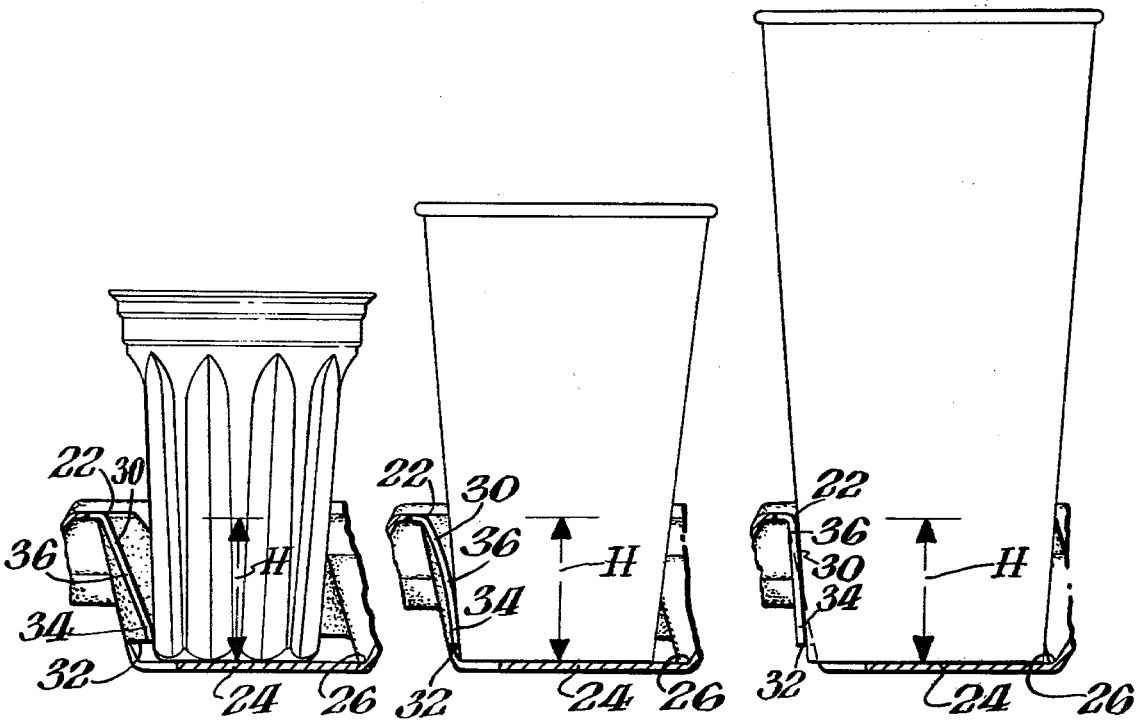
Fig. 2. Fig. 3. Fig. 4.

CONTAINER HOLDING SOCKET FOR MOLDED TRAY

BACKGROUND OF THE INVENTION

The claimed invention relates to the field of articles or products designed to support individually one or more containers in an up-right position, and more particularly to carrying or packaging trays which are molded to substantially finished form with horizontal and sloping but no substantially vertical wall portions to permit like empty trays to be nested one within another in a compact and convenient stack of such trays for shipment and storage prior to use.

A non-exclusive example of such a tray product is the one-use disposable carry trays molded of fibrous pulp or foamed plastic material designed to hold one or more beverage cups, and optionally additional food products, as used in the carry-out fast food and beverage trade. Another example is the packing trays designed to hold a plurality of containers such as jars, bottles or the like, and protect them against mutual contact and breakage, in shipping cases or cartons.

Prior to the present invention, a wide variety of carry-out trays have been proposed for the food service business, many of which include an arrangement of one sort or another for receiving a beverage cup and minimizing the possibility that it will tip and spill. One commercially successful cup holder for stackable carry trays of this general type is disclosed in Crabtree U.S. Pat. No. 3,915,371 (Oct. 1975), the same container-cradling aperture concept also being disclosed in Theobald U.S. Pat. No. 3,587,915 (June 1971). The cup holder employing container-cradling apertures of the aforesaid Crabtree patent has been recognized as a significant advance in the art of cup holders for molded carry trays, but at least two disadvantages have become apparent as a result of commercial use of this type of holder.

First, the cup holding recess of the type disclosed in the aforesaid Crabtree patent is designed primarily for only one size of cup-shaped container. It functions extremely well for a container of the size for which it is designed, but it is less effective in preventing against tipping those containers which are narrower than the size for which it is designed. The provision of small bend-down or break-away tabs facilitates the use of the Crabtree cup holder with the narrower size containers, but this is only a functional compromise at best.

Second, the cup holding recess of the type disclosed in the aforesaid Crabtree patent requires two or more relatively large container-cradling apertures in each cup holder, which are an essential functional feature but which detract from the visual aesthetic appearance of the tray. Market reaction suggests that a carry tray which does not appear to have gaping holes in the cup holder would meet with significantly increased consumer acceptance.

Thus, the problem heretofore unsolved in the prior art is an inexpensive stackable tray including at least one socket for holding a cup-shaped container within a predetermined range of sizes of such containers, and which additionally avoids the appearance of large apertures or holes in the tray.

SUMMARY OF THE INVENTION

The invention provides an inexpensive stackable tray including at least one socket for holding a cup-shaped container within a predetermined range of sizes of such containers, the socket comprising three stabilizing shoulders at a height significantly above the bottom of the socket, and an inwardly contoured stabilizing wall extending downwardly beneath each shoulder in a manner which avoids the appearance of large apertures or holes in the tray, the stabilizing walls being yieldable so that they or portions of them may be moved outwardly by the intermediate and wider sizes of containers as such a container is inserted vertically downwardly into the socket.

BRIEF DESCRIPTION OF THE DRAWINGS

Numerous advantages of the present invention will become apparent to one of ordinary skill in this art from a reading of the detailed description in conjunction with the accompanying drawings, wherein similar reference characters refer to similar parts, and in which:

FIG. 1 is a pictorial view in perspective showing a tray according to this invention, and with cup-shaped containers inserted in the container holding sockets;

FIG. 2 is a schematic view showing the relationship of one stabilizing shoulder and one stabilizing wall with a narrower size container in the socket;

FIG. 3 is a schematic view showing the relationship of one stabilizing shoulder and one stabilizing wall with an intermediate size container in the socket;

FIG. 4 is a schematic view showing the relationship of one stabilizing shoulder and one stabilizing wall with a wider size container;

DETAILED DESCRIPTION

Figure 5:
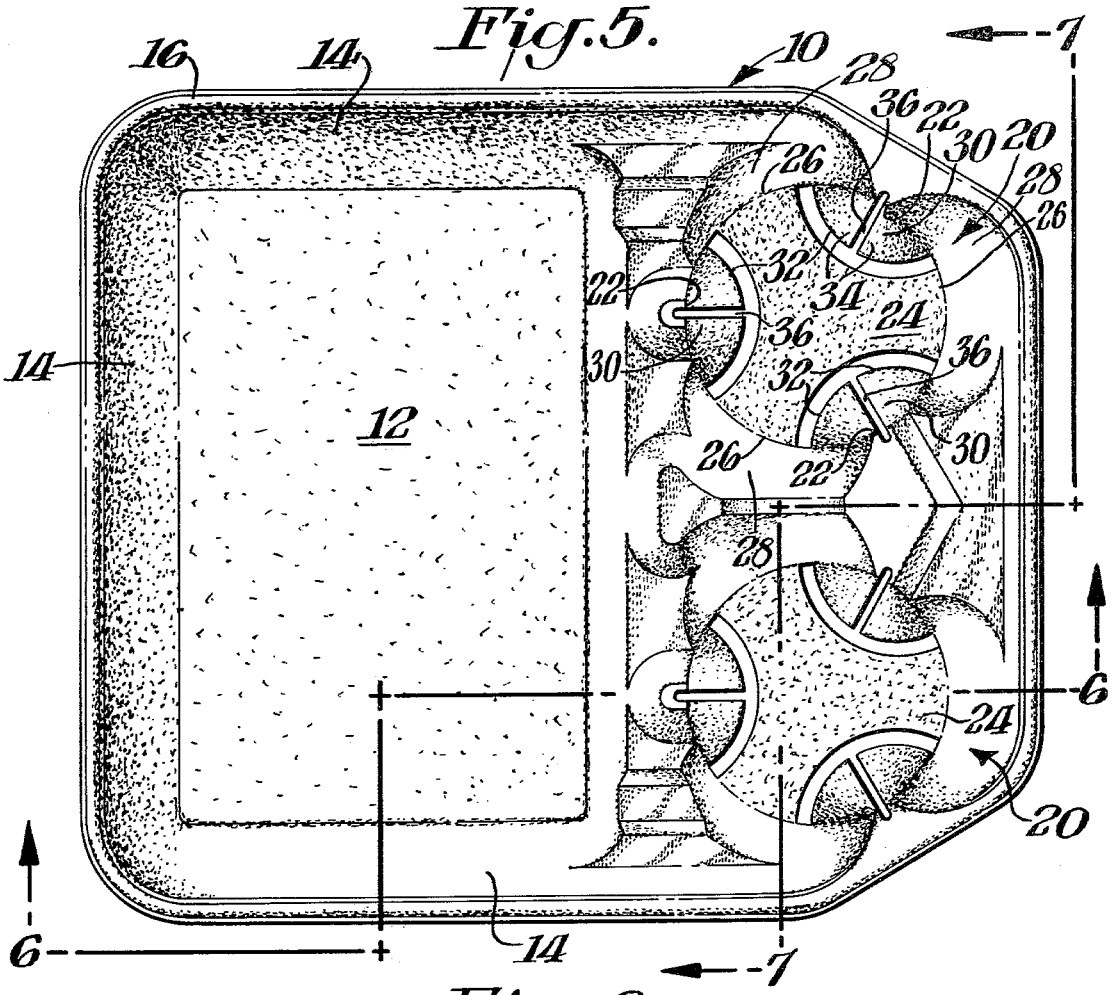
FIG. 5 is a plan view of an empty tray.
Figure 6:
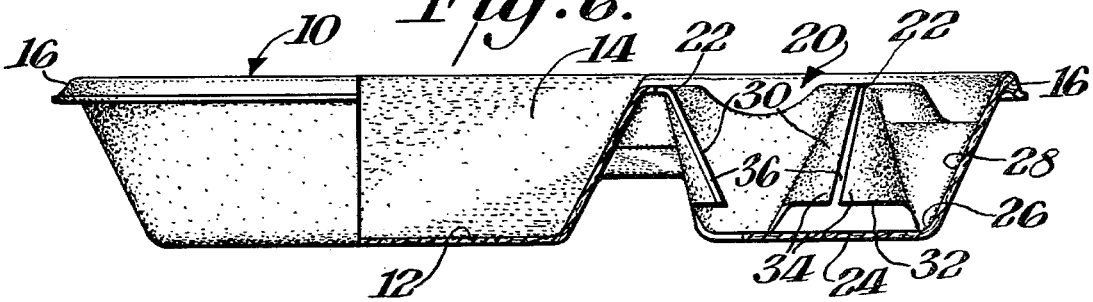
FIG. 6 is a side elevational view, partly in sectional elevation on line 6—6 of FIG. 5; and, FIG. 7 is an end elevational view, partly in sectional elevation on line 7—7 of FIG. 5.
Figure 7:
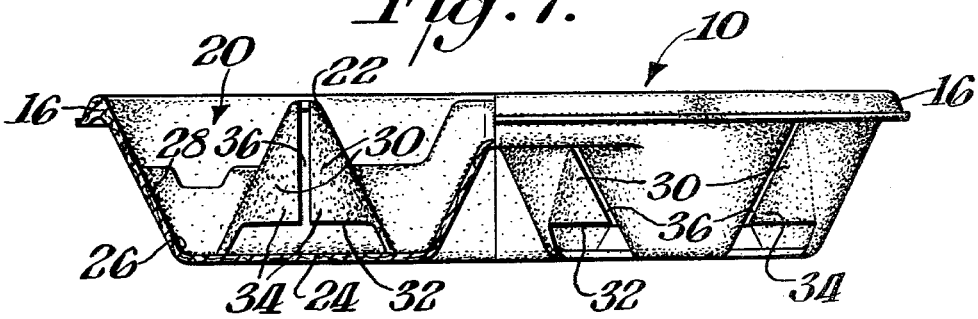

The container holding socket for molded trays according to this invention is useful in a wide variety of trays, although the best mode now contemplated of carrying out this invention is set forth herein in connection with a unitary molded carry tray for use in fast food and beverage establishments.

Other modes and embodiments certainly are contemplated, however, including packing trays designed to hold a plurality of containers such as jars, bottles or the like, and protect them against mutual contact or breakage, in shipping cases or cartons. Such a tray is disclosed, for example, in connection with FIGS. 12–14 of the aforesaid Crabtree patent.

The container holding socket of the present invention is described herein in connection with a carry tray having two container holding sockets, and an additional rectangular section for holding additional food products. Other designs of carry trays with which the container holding socket of the present invention is useful are disclosed, by way of example, in Vigue U.S. Pat. Nos. Des. 236,575 (Sept. 1975), Des. 249,620 (Sept. 1978), Des. 249,622 (Sept. 1978), Des. 249,769 (Oct. 1978) and Des. 250,243 (Nov. 1978). A tray with one socket in the right-hand corner, and an "L" shape section for other food products, is contemplated for use in serving individual meals or snacks in airplanes, hospitals, schools, and the like.

The unitary tray 10 is molded to substantially finished form of resilient material, such as fibrous pulp material molded against screen-covered, open-face, vacuum forming molds, after a well-known fashion. The tray could with equal facility be molded to substantially finished form of foamed plastic or any other material having the requisite cost, strength, resiliency and other characteristics useful for trays of this type. Whatever the material or method of molding employed, a feature of this invention is that the tray consists of horizontal wall portions and sloping wall portions, but no substantially vertical wall portions, which permits a quantity of like empty trays to be stacked in nested fashion one within another, to provide compact stacks of such empty trays for economical shipment, and convenient storage purposes prior to use.

The tray 10 comprises a generally rectangular tray having a flat horizontal bottom wall portion 12, upwardly and outwardly sloping side wall portions 14, and a down-turned continuous peripheral flange 16. The tray 10 includes two container holding sockets 20, each socket designed to hold one cup-shaped container within a predetermined range of sizes of such containers. Such containers, by way of example, include the narrower size juice "glasses", the several intermediate sizes of soft drink and coffee cups, and the wider size milkshake containers, some of the same being illustrated in FIGS. 2, 3 and 4, respectively. Most such containers are circular in cross-section, with slightly tapered sides, and are made from paper or various plastic materials. Other materials and other shapes, such as containers with fluted walls, and/or with straight cylindrical walls, can be accommodated with equal ease by the container holding socket of this invention.

Each container holding socket 20 comprises three stabilizing shoulders 22 positioned in spaced apart opposition to each other around the socket. In the illustrated embodiment, the three shoulders 22 are spaced apart substantially equally around the socket, although this is not considered to be an essential feature of the invention. By the same token, the use of three stabilizing shoulders is not considered to be essential, because it is contemplated that four or more such stabilizing shoulders could be provided in connection with the container holding socket, provided that the other operative features of the socket are not defeated. In the illustrated embodiment, the operative portion of each of the three stabilizing shoulders 22 coincides with a circle of only very slightly greater diameter than the diameter of the widest size of container within the predetermined range which the socket is designed to accommodate. If such largest size container has tapered walls, then the aforesaid diameter is that which exists at the height of the container, when fully inserted in the socket, which is the same height as the shoulders 22 of the socket 20.

To this end, the three stabilizing shoulders 22 are located at a height significantly above the level occupied by the bottom of a container fully inserted in the socket 20. That level is defined by a substantially horizontal wall portion 24, which may take the form of a web integrally connected as at 26 to sloping wall portions 28 of the tray at three locations around the socket which are intermediate between the three stabilizing shoulders 22. With reference to the average size range of drinking containers for beverages, which the container holding socket of the illustrated embodiment is designed to accommodate, the stabilizing shoulders 22 are at a height of between about one inch and about two inches above the level defined by the upper surface of the bottom web wall 24. In the preferred embodiment, this distance H is about one and one-half inches, although this dimension certainly is not critical. For example, when considering a socket for holding containers such as tall quart size bottles in a shipping carton, the height naturally should be proportionately larger than the aforesaid range.

The container holding socket 20 is further characterized by three inwardly contoured stabilizing walls 30, one extending downwardly beneath each of the shoulders 22. The stabilizing walls 30 extend downwardly to a height only slightly above the level defined by the upper surface of the bottom wall web 24. In the illustrated embodiment, the stabilizing walls extend downwardly to a height of no more than about one-half inch above that level. The lower edge 32 accordingly forms a narrow opening above the exposed curved edges of the web 24.

The stabilizing walls 30 are contoured inwardly to the extent that their lower portions 34 properly position at least the narrow sizes of containers in the range of sizes which the socket is dimensioned to accommodate. In this sense, the lower portions 34 of the three stabilizing walls 30 act to center the container as and after it is inserted into the socket. With the narrower sizes of containers, when the same are fully inserted in the socket so that the container bottom rests on the flat web 24, the lower portions 34 of the stabilizing walls provide a small amount of resilient pressure to insure that the container is properly supported in an upright position with its bottom on the flat web 24.

The stabilizing walls 30 are yieldable, so that they or at least the lower portions 34 of them will be moved outwardly by, but still support, the intermediate and larger sizes of containers. The yieldability of the stabilizing walls is controlled by several factors, such as the thickness, density and nature of the fibrous pulp or plastic material of which the tray and its stabilizing walls are made, the degree of curvature of the inwardly contoured portions of the stabilizing walls, the angle of slope of the innermost portions of the stabilizing walls with respect to the vertical, and the like.

Another means to control the yieldability of the stabilizing walls includes a vertically oriented slot 36 extending upwardly from the lower edge 32 of each stabilizing wall 30. The slot 36 in effect divides at least the lower portions 34 of the stabilizing walls into two separated container-contacting sections. In the illustrated preferred embodiment, each slot 36 extends upwardly throughout the full vertical extent of its stabilizing wall, and intersects the stabilizing shoulder 22. This in effect divides the operative portion of each shoulder 22 into two separate sections, for contacting the wider sizes of containers, as explained above. The extension of the slot to such a height that it intersects the stabilizing shoulder, however, is not considered to be an essential feature of the present invention.

Each slot 36 accordingly forms, together with the opening beneath the lower edge 32 of each stabilizing wall, an inverted "T" shape opening through the tray beneath each stabilizing shoulder. In the preferred embodiment, each slot 36 is of substantially uniform width throughout its full vertically oriented extent, although a slot which is widened at its lower portions adjacent the lower edge 32 of the stabilizing wall would not defeat the operative principals of the present invention. In the illustrated embodiment, the inverted "T" shape opening which characterizes each stabilizing wall is not extensive, and avoids the appearance of large apertures or holes in the tray. This improves the visual aesthetic appearance of the tray, and also has the functional advantage of making the container holding socket available for alternative use as a receptacle for holding one or more small individual serving packs of salt, pepper, sugar, mustard, ketchup, tarter sauce, or the like, which easily could fall through the large container-cradling apertures of the tray disclosed in the aforesaid Crabtree patent. Additionally, the three downwardly and inwardly oriented slots 36 associated with each socket serve to guide the bottom of a container as it is inserted vertically downwardly into the socket. This facilitates centering of a container as and after it is inserted into the socket, and also serves to apportion outward movement of the separated container-contacting sections of the stabilizing walls 30, particularly the lower portions 34 thereof.

The aforesaid means to control the yieldability of the stabilizing walls, including the slots 36, insure that the stabilizing walls, and at least the lower portions of them, may easily be moved outwardly by the intermediate sizes of containers, but in such a manner that the walls still will support such containers in the socket, as illustrated in FIG. 3.

With the wider sizes of containers in the predetermined range which the socket is designed to accommodate, including the widest size, the stabilizing walls are displaced outwardly to the extent that such containers are supported against tipping principally by the spaced apart shoulders 22, although the outwardly flexed stabilizing walls additionally exert a substantial container stabilizing force.

In the usual situation, the wider sizes of containers are considerably and proportionately taller than the narrower sizes of containers, and thus require more positive stabilization because of their higher center of gravity. The container holding socket of this invention utilizes this fact in achieving its ability to accommodate a range of sizes of containers. The narrower sizes are supported principally by the lower portions 34 of the stabilizing walls, as explained above, and in practice this provides sufficient stabilization for such containers. By contrast, the largest size container is supported principally by the shoulders 22, which provide extremely positive anti-tipping action. The intermediate sizes of containers benefit from the same principals, in effect insuring that the wider the container, and thus the higher its center of gravity, then the greater the stabilizing force provided by the outwardly flexed stabilizing walls—up to the point where the positive shoulders provide greater stabilizing force than the outwardly flexed walls.

While the above described embodiment constitutes the best mode now contemplated of carrying out the invention, other embodiments and functional equivalents thereof are specifically asserted to be within the scope of the actual invention, which is claimed as:

1. A unitary tray molded to substantially finished form of resilient material with horizontal and sloping but no substantially vertical wall portions to permit like empty trays to be nested one within another in a stack of such trays for shipment and storage, the tray including at least one socket for holding a cup-shaped container within a predetermined range of sizes of such containers, the container holding socket comprising three stabilizing shoulders positioned in spaced apart opposition to each other around the container holding socket at a height significantly above the level occupied by the bottom of a container fully inserted in the socket, characterized in that an inwardly contoured stabilizing wall extends downwardly beneath each of the shoulders to a height only slightly above the level occupied by the bottom of a container fully inserted in the socket, the stabilizing walls being contoured inwardly to the extent that they properly position in the socket at least the narrower sizes of containers, the stabilizing walls being yieldable so that they or at least the lower portions of them will be moved outwardly by but still support the intermediate sizes of containers, and the stabilizing walls being displaceable outwardly by the wider sizes of containers to the extent that such containers are supported against tipping principally by the spaced apart stabilizing shoulders.

2. A tray as in claim 1 wherein the stabilizing shoulders are at a height of between about one inch and about two inches above the level occupied by the bottom of a container fully inserted in the socket, and the stabilizing walls extend downwardly to a height of no more than about one-half inch above the level occupied by the bottom of a container fully inserted in the socket.

3. A tray as in claim 1 wherein the stabilizing walls include means to control their yieldability so that they or at least the lower portions of them may easily be moved outwardly by the intermediate sizes of containers but still will support such containers in the socket.

4. A tray as in claim 3 wherein the means to control yieldability of the stabilizing walls includes a vertically oriented slot extending upwardly from the lower edge of each stabilizing wall to divide at least the lower portions thereof into two separated container-contacting sections.

5. A tray as in claim 4 wherein the slot in each stabilizing wall extends upwardly throughout the full vertical extent of the wall and intersects the stabilizing shoulder, dividing the operative portion of the shoulder into two separated sections for contacting the wider sizes of containers.

6. A tray as in claim 4 wherein the slot and the lower edge together form as a characteristic of each stabilizing wall an inverted "T" shape opening through the tray beneath each stabilizing shoulder.

7. A tray as in claim 6 wherein the slot in each stabilizing wall is of substantially uniform width throughout its full vertically oriented extent.

8. A tray as in claim 7 wherein the three slots serve to guide the bottom of a container as it is inserted vertically downwardly into the socket, and to apportion outward movement of the separated container-contacting sections of the stabilizing walls.

9. A tray as in claim 8 wherein the three slots are spaced apart substantially equally around the socket, and are each of substantially the same width, to facilitate centering of a container as and after it is inserted into the socket.

10. A tray as in claim 9 wherein the level occupied by the bottom of a container fully inserted in the socket is defined by a substantially horizontal wall portion in the form of a web integrally connected to sloping wall portions of the tray at three locations around the socket which are intermediate between the three inwardly contoured stabilizing walls.

* * * * *